US007313942B2

(12) United States Patent
Braun

(10) Patent No.: US 7,313,942 B2
(45) Date of Patent: Jan. 1, 2008

(54) FORGING MACHINE FOR THE UPSETTING OF DEFORMED REINFORCEMENT BARS

(75) Inventor: Jean-Jacques Braun, Bangkok (TH)

(73) Assignee: Dextra Asia Co., Ltd., Bangkok (TH)

( * ) Notice: Subject to any disclaimer, the term of this patent is extended or adjusted under 35 U.S.C. 154(b) by 140 days.

(21) Appl. No.: 11/092,086

(22) Filed: Mar. 29, 2005

(65) Prior Publication Data

US 2005/0262914 A1 Dec. 1, 2005

(30) Foreign Application Priority Data

May 27, 2004 (IN) ..... 965/DEL/2004

(51) Int. Cl.
*B21J 5/08* (2006.01)

(52) U.S. Cl. ..... 72/318

(58) Field of Classification Search ..... 72/318, 72/316, 377, 312, 456; 470/8, 84
See application file for complete search history.

(56) References Cited

U.S. PATENT DOCUMENTS 3,292,412 A * 12/1966 Costabile ..... 72/335
3,919,877 A * 11/1975 Netta ..... 72/456
4,126,936 A * 11/1978 Koller ..... 29/863
4,295,357 A * 10/1981 Roper ..... 72/344
4,619,096 A 10/1986 Lancelot
5,152,118 A 10/1992 Lancelot
5,158,527 A 10/1992 Bernard
5,308,184 A 5/1994 Bernard
5,660,594 A * 8/1997 Viljakainen ..... 470/10
5,709,121 A * 1/1998 Camping ..... 72/316
5,776,001 A * 7/1998 Carter ..... 470/8
5,799,528 A * 9/1998 Camping ..... 72/318
6,230,537 B1 * 5/2001 Easterbrook ..... 72/334
6,679,092 B2 * 1/2004 Irii ..... 72/457
6,708,548 B2 * 3/2004 Ehrke et al. ..... 72/312
6,735,994 B2 5/2004 Buhler et al.

FOREIGN PATENT DOCUMENTS

FR 2653809 A1 * 5/1991
WO WO 99/36207 * 7/1999

* cited by examiner

*Primary Examiner*—Daniel C Crane
(74) *Attorney, Agent, or Firm*—Egbert Law Offices

(57) ABSTRACT

Forging machine for the cold forging of deformed steel bars includes upsetting and clamping dies housed in the same casing. The dies bear a continuous cavity so as to enable forging of long products.

6 Claims, 2 Drawing Sheets

FORGING MACHINE FOR THE UPSETTING OF DEFORMED REINFORCEMENT BARS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to head-forging, also known as "upsetting", of long metal bars, and in particular to the cold forging of deformed steel bars for the reinforcement of concrete constructions.

BACKGROUND OF THE INVENTION

Deformed bars are notoriously difficult to handle by mechanical means not only because of their length and weight, but also because of their extremely wide variations in shapes, dimensions, chemical composition, strength, stiffness, and other related mechanical properties.

These bars need however to be mechanically handled in order to provide continuity of reinforcement in concrete structures. This continuity of reinforcement is best provided by not reducing the properties of the bars themselves at the location of their connection, while still being feasible in a convenient and economical way.

The first method imagined to create such a convenient and economical connection was to make a thread on the bar ends as shown on FIG. 1, thereby enabling to link them to another bar by means of an internally-threaded connector. Such a solution presents the disadvantage of reducing the bar properties at the location of their connection because of the reduction of cross-section area from the machining of the thread.

This method was then improved into making the thread conical rather than parallel, as illustrated on FIG. 2. By taking advantage of the mechanical lock effect of a cone-to-cone contact, the conical-threaded bar connector can reach a performance close to that of the bar itself, and is at present the most widely used system on the market.

However, although providing a tensile strength close to that of the bar, the conical thread connector fails to maintain the ductility of the bar, because of the brittle nature of its failure mode under tensile load.

In order to remedy this, it has been imagined to enlarge the bar end prior to making a thread on it, thereby avoiding to reduce the cross section area of the bars at the location of their connection.

Such an enlargement is best done by forging, but unfortunately lacked the industrial means to produce it effectively and economically. Indeed, forging machines have so far been developed for the mechanical industry, and not for the construction industry. Materials used in the mechanical industry are of regular and accurate dimensions, and of homogeneous properties from one batch to another. By contrast, manufacturers of deformed bars for the reinforcement of concrete are not bound to any dimensional accuracy other than a weight tolerance of up to 5% on the tonnage produced. Worse, the regulations and habits regarding the steel grade used, the shape and dimensions of their ribs and surface vary greatly from one country to another. All of this made the use of an industrially-designed forging press all but impossible.

BRIEF SUMMARY OF THE INVENTION

The purpose of the present invention is to provide a forging machine that enables to prepare deformed steel bars in view of their subsequent threading that is versatile enough to adapt to any steel grade and bar shape and dimension, yet remains convenient and economical to use.

According to the invention, the forging machine for the preparation of steel reinforcement bars in order to connect them by an internally-threaded coupler is characterized by having means to upset the ends of deformed steel bars while its frame and construction design allow long products to go through at least one side of the machine. In order to withstand the forging effort on a long product, it also has means of holding the bar into position. Finally its forging die is specifically designed to accept bars with considerable variations of properties.

Another important novelty is that the face of the forging piston may be used in its retracted position as a stopper for the material to be forged, so that the adjustment of the retracted position of said forging piston will enable to adjust the volume of material to be pressed into the mold.

The present invention will be better understood from the following description together with the drawings that are an integral part of it. These are however only given as an example and are not intended to limit its scope.

DETAILED DESCRIPTION OF THE INVENTION

Figure 1:
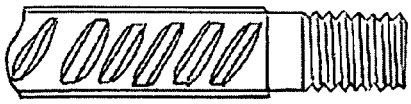
FIG. 1 is a side elevational view of a prior art connector of a rebar.
Figure 2:
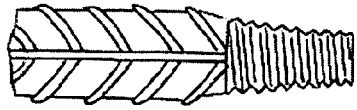
Fig 2. PRIOR ART
FIG. 2 is a side elevational view of another prior art connector of a rebar.
Figure 3:
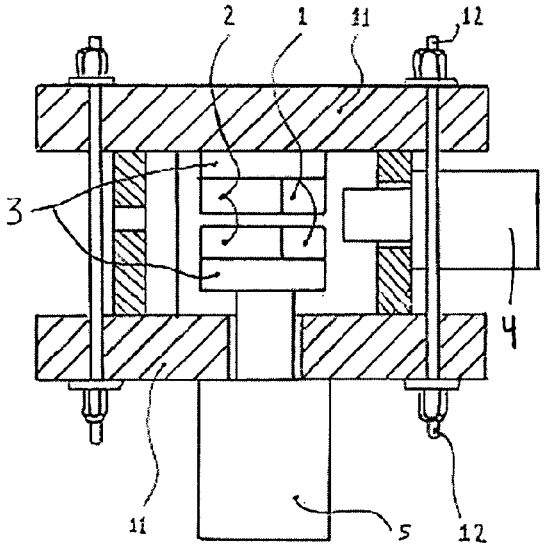
FIG. 3 is a side elevational view of the forging clamping means of one embodiment of the present invention.

FIG. 3 shows the forging machine in a particular embodiment. The forging means (1) and the clamping means (2) are housed in the same housing (3).

Figure 4:
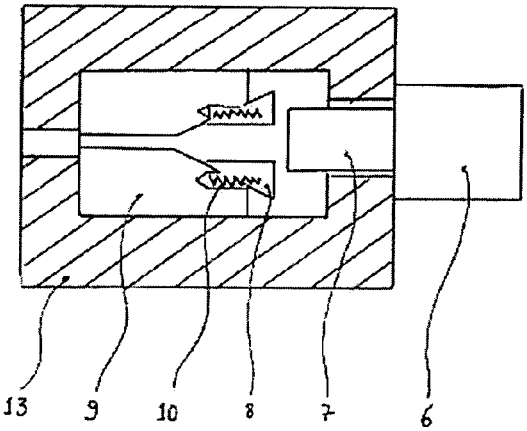
FIG. 4 is a side elevational view of the forging and clamping means of another embodiment of the present invention.

The forging means and the clamping means may be in approximately perpendicular configuration as shown in FIG. 3, or in approximately parallel configuration as shown in FIG. 4. In the embodiment of FIG. 3, the forging means comprise a cylinder (4), that could be hydraulically powered. The clamping means comprise another cylinder (5), that could also be hydraulically powered. In the embodiment of FIG. 4, a single cylinder (6) actuates through its piston (7) both the forging means and the clamping means. The forging and clamping means (8) have the ability to slide into their casing (9). Retractable means (10), that could be springs, bring back the forging and clamping means to their original position at the end of the cycle.

The frame of the machine could be made of plates (11) held together by tension bars (12) as shown in the embodiment of FIG. 3. Or it could be made of a single part (13), whether monolithic or of welded assembly, as shown in the embodiment of FIG. 4.

Figure 5:
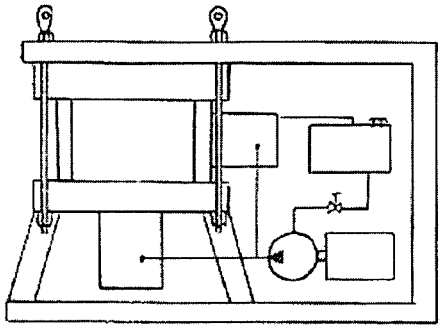
FIG. 5 is a side elevational view of the frame and lifting device of the present invention.

Because the long bars to be processed are generally of considerable weight, it is often more economical to bring the machines to the bars, be it to the steel mill, to the cut-and-bend factory, or directly to the construction site, rather than bring these bars to the machine. The frame of the machine may thus be fitted with lifting devices as shown on FIG. 5. Also shown on FIG. 5 is an embodiment where the power unit is conveniently housed inside the frame or housing of the machine.

Figures 6, 7, 8, 9, 10:
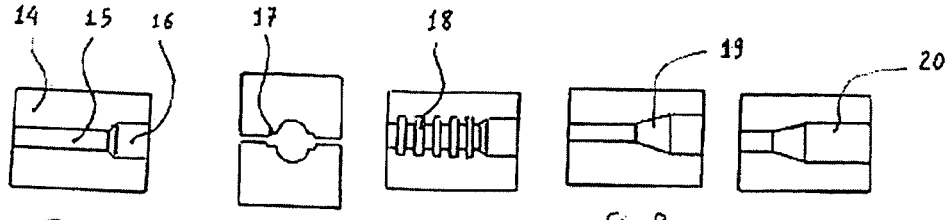
FIG. 6 is a cross-sectional view of a die as used in the present invention.
FIG. 7 is a front view of the die as used in the present invention.
FIG. 8 is a cross-sectional view of the die of the present invention as fitted with teeth.
FIG. 9 is a cross-sectional view of another type of forging die as used in the present invention.
FIG. 10 is a cross-sectional view of still another type of forging die as used in the present invention.

Another important novelty of the forging means is shown on top view FIG. 6, where a die (14) bears a go-through cavity (15) designed approximately to the dimension of the long bar to be processed, so that said long bar can go all the way through said die. The die also bears a larger, upsetting cavity (16) that is designed approximately to the dimension of the enlargement that is sought to strengthen enough the bar end before threading.

In order to accept deformed bars of varying dimensions and sizes, and in particular of varying rib shapes and sizes, said upsetting cavity (16) may bear flow-out hollowings (17) as shown on front view FIG. 7. Said flow-out hollowings allow the extra-material coming from over-sized bars to find extra space, avoiding the accumulation of stresses inside both the bar end and the forging means.

The go-through cavity may be machined or fitted with gripping teeth (18) as shown on FIG. 8 in order to improve the clamping action.

In order to accept deformed bars of varying mechanical properties and shapes, several forging dies with increasingly progressive variations (19) of diameter enlargement may be provided as shown on FIG. 9.

In some occasions, for example when the bars are too heavy to be rotated, or when its location or configuration at the construction site makes it impossible or difficult to rotate, it may be convenient that the internally-threaded connector can be screwed completely onto one of the bars to be connected. The present invention easily solves this problem by continuing the threading of the bar end on the ribs beyond the upset area, or on a longer upset area made by a forging die bearing an extended upsetting cavity (20) as shown on FIG. 10.

Figure 11:
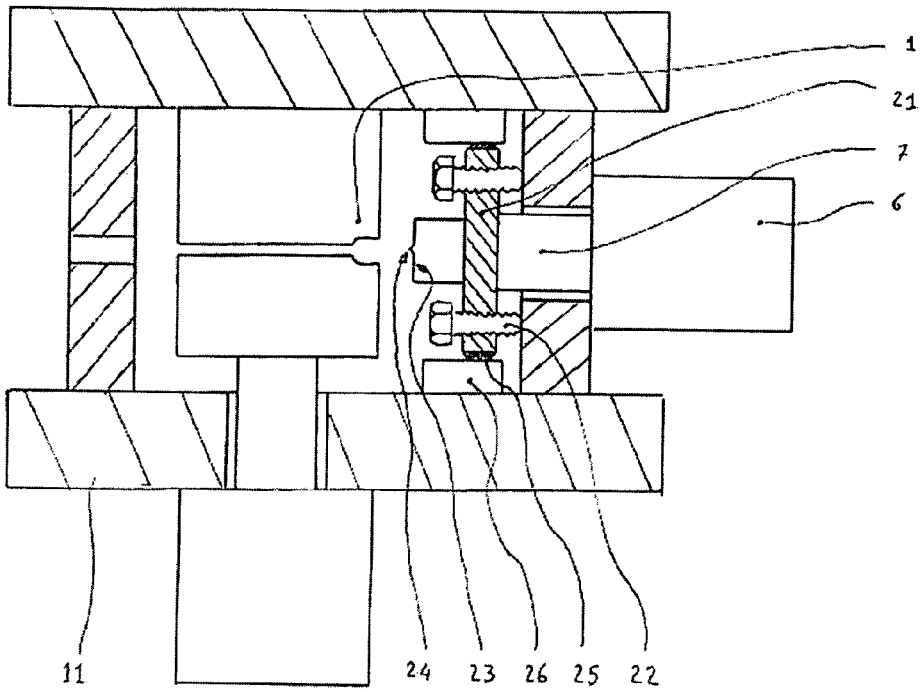
FIG. 11 is a side elevational view of anther embodiment of the forging machine of the present invention.

Another novelty of the present invention is to enable the machine to adapt itself to bars of varying sizes and shapes by having its stroke easily adjustable. Standard industrially-designed forging presses are controlled by the pressure of their power unit. Their stroke may be adjustable by a lengthy down time and by qualified technicians, both of which are not available on a construction site. The present invention solves this problem by a simple device, shown on FIG. 11, that can be understood and operated by any worker, be it at a steel mill, cut-and-bend workshop, or construction site: a support (21) is fitted on the piston (7) of the forging cylinder (6). A stroke-adjusting device (22) is fitted on this support, leaving the desired forging length l between the extremity (23) of the piston (7) and the forging means (1). The novelty of this feature comes from the fact that simply inserting the bar until it touches said extremity of the forging piston will provide the required forging length. The embodiment shown on FIG. 11 is of a mechanical type but is given only as illustration purpose and is not intended to limit its scope. Other variations, electric or otherwise, may be developed by the Man-of-the-Art while still being covered by the present invention.

Another novelty of the present invention, also shown on FIG. 11, are marks or relief shapes (24) that may be added to the extremity (23) of the forging piston (7) in order for example to leave a trace-ability mark or a brand name on the bars being processed, or else to solve the problem of weak or bent bars that otherwise would be buckling under the compression effort. In the past, an additional process step to mark each and every bar was too expensive, and the only batch identification provided was by means of labels affixed to each bundle. Identification of bundles rather than individual bars was far from error-free as some bars could slip out of a bundle, or simply be forgotten, and thus loose their trace-ability. The labels tend also to be destroyed during handling or transportation, by the crane hooks or on the truck beds. Their ink tends also to be washed away by rain or sun.

Another novelty of the present invention, also shown on FIG. 11, is a device (25) that prevents the rotation of the piston (7) of the forging cylinder (6) under the forging effort. Indeed, unlike industrially-manufactured pieces, where the material to be processed is prepared accurately at the required shape and dimensions, deformed bars have a very uneven end from bending, sawing or cutting. This uneven end creates dissymetrical efforts during the forging operation that are transmitted to the piston head and make it turn in the predominant direction of these efforts. This phenomenon is solved by the device of the invention, shown as sliding pads (25) that glide over a wear-off guideway (26) that is fixed on the frame of the machine.

Figure 12:
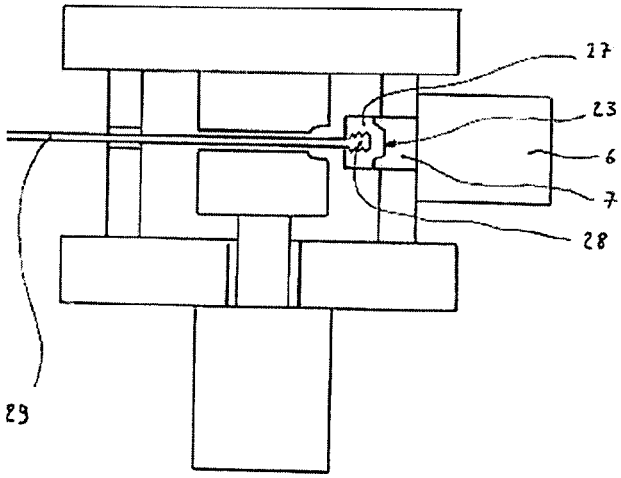
FIG. 12 is a side elevational view showing the operation of the forging machine of the present invention.

Many other uses of the invention, accessible to the Man-of-the-Art, may be developed without exiting the scope of the invention. For example, such a development could be to use the machine reversely, as shown on FIG. 12: an adapter (27) is fixed on the extremity (23) of the piston (7) of the forging cylinder (6) and can be fixed or screwed onto the upsetted or threaded end (28) of the bar (29). The machine can thus also pull on the threaded bar instead of pushing on it, for example for the purpose of straightening it or pre-loading it.

I claim:

1. A forging press for the cold forging of a concrete reinforcement bar so as to form a cold upset at an end of the bar, the forging press comprising:

a frame having a first side and a second side with a plurality of tie-rods supporting said first and second sides in generally parallel relation, said plurality of tie-rods connected to said first side and said second side so as to adjust a distance between said first and second sides;

a clamping means affixed to said first and said second sides for selectively clamping the bar in a position between said first and second sides such that the bar extends in parallel relation to said first and second sides; and a forging means positioned between said first and second sides, said forging means for applying a force onto an end of the bar clamped by said clamping means, said forging means having a piston movable under force toward an end of the bar.

2. A forging press for the cold forging of a concrete reinforcement bar so as to form a cold upset at an end of the bar, the forging press comprising:

a frame having a first side and a second side connected by a plurality of tie-rods, said plurality of tie-rods connected to said first and second sides so as to adjust a distance between said first and second sides;

a clamping means affixed to said frame for selectively clamping the bar in a position within said frame;

a forging means positioned in said frame, said forging means for applying a force onto an end of the bar clamping by said clamping means, said forging means having a piston movable under force toward an end of the bar, said piston having an end surface with a marking thereon, said mark being identification indicia, said forging means for forming the identification indicia onto the end of the bar.

3. The forging press of claim 2, further comprising:

a guide affixed to said frame and cooperative with said piston so as to prevent a rotation of said piston as the piston applies the force onto the end of the bar.

4. The forging press of claim 2, said end of said piston being of an adjustable distance from the end of the bar.

5. The forging press of claim 2, further comprising:

a sensor means cooperative with said forging means for stopping said piston before said piston contacts a die received in said clamping means.

6. The forging press of claim 2, further comprising:

a housing receiving said clamping means and said forging means therein.

* * * * *